United States Patent [19]

Roberts

[11] 3,952,792

[45] Apr. 27, 1976

[54] METHOD AND APPARATUS FOR CASTING A PLURALITY OF INGOTS

[75] Inventor: Raymond J. Roberts, Willingboro, N.J.

[73] Assignee: Consarc Corporation, Rancocas, N.J.

[22] Filed: July 25, 1974

[21] Appl. No.: 491,981

[52] U.S. Cl. ..... 164/52; 164/252

[51] Int. Cl.$^2$ ..... B22D 11/10; B22D 27/02

[58] Field of Search ..... 164/52, 252

[56] References Cited

UNITED STATES PATENTS

| | | | |
|---|---|---|---|
| 3,610,319 | 10/1971 | Kleinhagauer et al. | 164/252 |
| 3,782,445 | 1/1974 | Luchok et al. | 164/52 |
| 3,804,149 | 4/1974 | Medovar et al. | 164/252 |

*Primary Examiner*—Ronald J. Shore
*Assistant Examiner*—Gus T. Hampilos
*Attorney, Agent, or Firm*—Seidel Gonda & Goldhammer

[57] ABSTRACT

A method and apparatus for casting a plurality of ingots by forming a pool of molten metal in a main mold section which is in direct, open communication with a plurality of ingot mold sections by flowing the molten metal from the pool into the ingot mold sections. An electrode and a conductor establish an electrical current path, through the molten metal pool, which does not enter the ingot mold sections, and the cast ingots are electrically isolated at their lower ends.

22 Claims, 4 Drawing Figures

METHOD AND APPARATUS FOR CASTING A PLURALITY OF INGOTS

BACKGROUND OF THE INVENTION

This invention relates to a method and apparatus for casting a plurality of ingots. More particularly, this invention relates to a method and apparatus for casting a plurality of ingots from one or more electrodes and for eliminating the formation of deep molten cores in the ingots.

For a long time, the manufacture of ingots according to any one of several consumable electrode processes was generally limited to melting or remelting an electrode into an ingot whose cross-sectional area was larger than that of the electrode. Typically, the maximum ratio of electrode cross-sectional area to ingot cross-sectional area ranged up to about 80 percent. Although it was desirable to manufacture an ingot having a cross-sectional area smaller than the cross-sectional area of the electrode, metallurgical and economic restrictions made this difficult to achieve.

Recently, a method and apparatus was invented for casting a plurality of ingots which allowed the rates of the electrode cross-sectional area to the ingot cross-sectional area to exceed 100 percent. That invention is set forth in U.S. Pat. No. 3,782,445 for Method of Casting a Plurality of Ingots in a Consumable Electrode Furnace, issued to Luchok et al. on Jan. 1, 1974. The invention described therein permits casting a plurality of ingots while avoiding the aforementioned metallurgical and economic restrictions.

The cost of ingot manufacture by electroslag melting or other processes is in part a function of the rate of solidification of the ingot. In addition, the metallurgical quality of the ingot is a function of the solidification rate. The solidification rate, in turn, is a function of the ingot cross-sectional area. The smaller the ingot cross-sectional area, the lower the permissible solidification rate and, consequently, the smaller the number of pounds of ingot which can be cast per minute. Stated otherwise, the tolerable solidification rate for a given alloy is determined by the metallurgical characteristics and quality standards established by specification and, as a general rule, the tolerable solidification rate decreases with decreasing ingot cross-sectional area. Low ingot solidification rates, however, result in poor furnace utilization, increasing the unit cost of producing ingots.

Furthermore, the cost of manufacturing the electrode used in a consumable electrode process increases as the electrode diameter decreases. Consequently, prior to the invention set forth in U.S. Pat. No. 3,782,445, the manufacture of small ingots by consumable electrode processes and, in particular, the electroslag remelting process, had not been widely adopted for use in the manufacture of ingots of small cross-sectional area.

In U.S. Pat. No. 3,782,445, an apparatus and process is described for manufacturing small ingots by consumable electrode processes using electrodes of relatively wide diameters. In one application of the invention described therein, a molten metal pool is formed by melting an electrode according to classic electroslag remelting principles. The process entails suspending an electrode so that its lower end is immersed in a liquid slag bath. The lower end of the electrode is melted by passing current through the electrode and slag so that molten metal droplets form on the electrode and drop through the slag layer to form a molten metal bath. A plurality of ingots may be withdrawn from the molten metal bath.

Although the above method and apparatus permits the economical casting of a plurality of ingots, during casting an ingot may develop a deep molten metal core. The deep molten metal core causes a decrease in the rate of solidification of the ingot and, therefore, is undesirable. It is believed that the reason for the formation of the deep molten metal core is the attractive forces generated by the electrical current flowing in adjacent ingot mold sections.

It is well-known that an attractive force is generated between adjacent conductors which carry current in the same direction. For adjacent ingot sections, it is believed that the flow of electrical current in each ingot mold section creates an attractive force, and the force causes molten metal to flow out of an ingot mold section and back into the molten metal pool in the main mold section. As a result, the molten metal is circulated in the ingot mold section, and the circulation of the molten metal interferes with the gradual advance of the solidification front, i.e., the interface between the molten metal and the solidified ingot in the ingot mold section. The solidification front, then, remains relatively deep within the ingot mold section, and the ingot being cast has a deep molten metal core.

A principal advantage of the present invention is that a plurality of ingots may be cast from a pool of molten metal without the formation of deep molten metal cores in the ingots.

Another advantage of the present invention is that a plurality of ingots of satisfactory metallurgical quality can be cast at increased solidification rates, resulting in more efficient furnace utilization and decreased production costs.

Other advantages will be apparent from the description of the invention appearing below.

BRIEF SUMMARY OF THE INVENTION

Briefly, in the present invention, a method and apparatus are provided for casting a plurality of ingots. The invention includes forming a pool of molten metal in a main mold section having a larger cross-sectional area than the total cross-sectional area of a plurality of ingot mold sections in direct, open communication therewith, directing an electrical circuit through an electrode and a conductor, the conductor being located outside the ingot mold sections, casting the plurality of ingots from the molten metal pool by flowing the molten metal into the ingot mold sections while preventing the molten metal from freezing at the interface between the main mold section and the ingot mold sections, and preventing the electrical current through the conductor from entering the molten metal in the ingot mold sections.

BRIEF DESCRIPTION OF THE DRAWINGS

For the purpose of illustrating the invention, there is shown in the drawings forms which are presently preferred; it being understood, however, that this invention is not limited to the precise arrangements and instrumentalities shown.

DETAILED DESCRIPTION OF THE INVENTION

Figure 1:
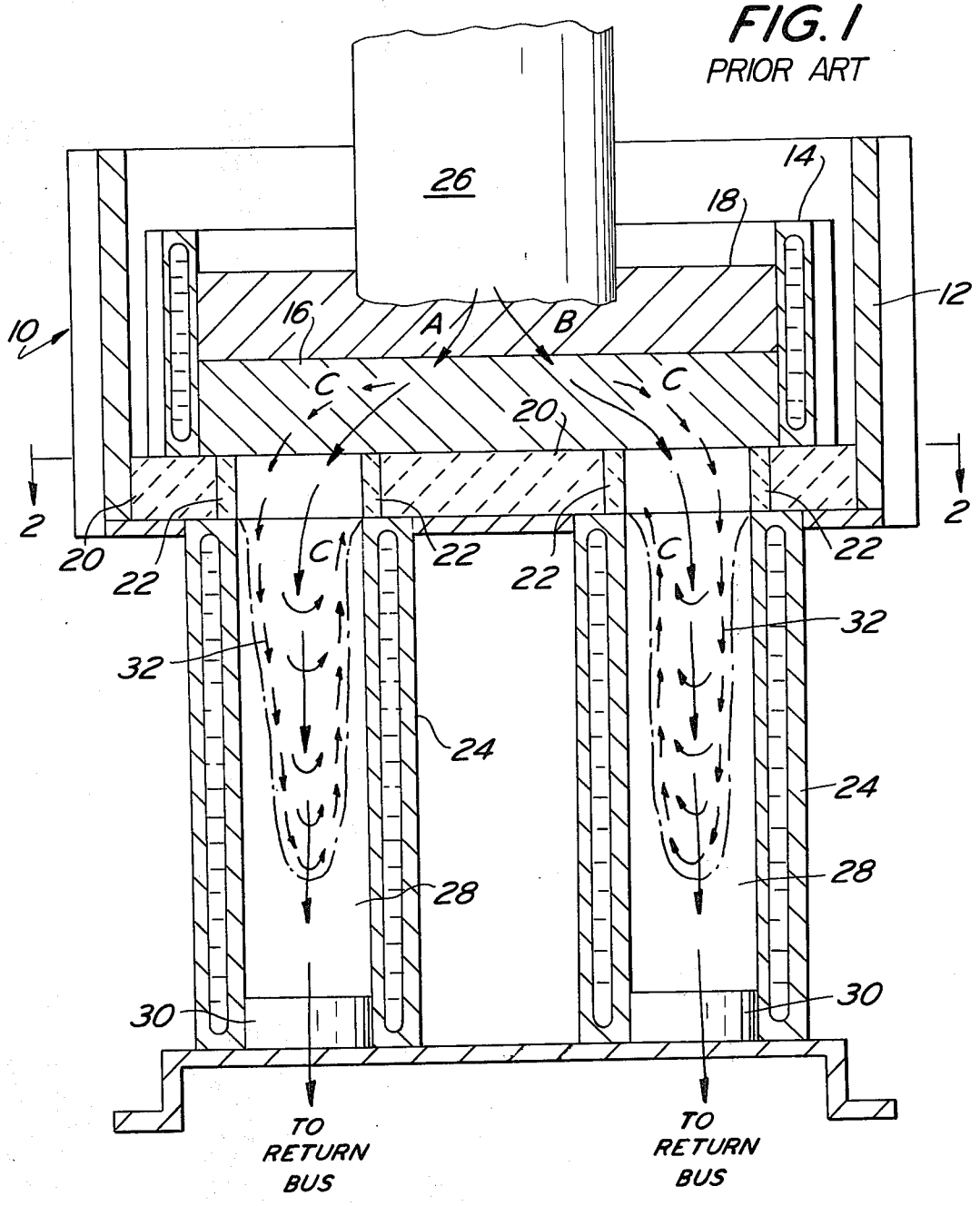
FIG. 1 PRIOR ART
FIG. 1 is a transverse sectional view of an electroslag furnace for casting a plurality of ingots.

Referring now to the drawings in detail, wherein like numerals indicate like elements, there is shown in FIG. 1 a transverse sectional view of a furnace used for casting a plurality of ingots and designated generally as 10. The furnace 10 includes an outer support shell 12 which houses an upper water cooled copper jacket 14 used to contain the molten metal 16 and the molten slag 18. The support shell 12 is provided with a refractory bottom 20. The refractory bottom 20 includes a replaceable refractory upper mold insert sleeve 22 which may be annular in construction. The water cooled jacket 14 together with the refractory bottom 20 and its insert 22 define what is hereinafter referred to as the main mold section.

In direct, open communication with the main mold section, through the refractory sleeve 22, are the water cooled copper ingot mold sections 24. It is in the copper ingot mold section 24 that ingots are continuously formed and withdrawn as solidification proceeds.

An electrode 26 is reciprocably supported with its end in the molten slag 18 by conventional apparatus for that purpose, not shown. Electrode 26 may have a cross-sectional area substantially larger than the cross-sectional area of an ingot mold section 24 and, hence, the cross-sectional area of an ingot 28 formed therein. In certain circumstances, it may be advantageous to use more than one electrode 26; the present invention contemplates the use of one or more electrodes to form the molten metal pool 16 by fusing under the slag 18. Moreover, the electrodes may have any convenient cross-sectional area; the electrode cross-sectional area may be less than, equal to, or greater than the cross-sectional area of an ingot.

The main mold section has a larger cross-sectional area than that of an ingot mold section 24. It is in the main mold section that the molten metal pool 16 is formed and the molten slag-molten metal interface maintained.

The refractory bottom 20 together with the refractory insert sleeve 22 provide thermal insulation allowing the molten metal pool 16 to remain molten. If any portion of the pool 16 located above the refractory bottom 20 solidifies, then either the ingot 28 will jam in the ingot mold section 24 or the surface of the ingot 28 will tear. To avoid jamming and tearing, the refractory bottom 20 and refractory sleeve 22 sufficiently insulate the molten metal 16 from the cooling effects of the ingot mold section 24 and the jacket 14 to prevent solidification at or near the interface between the ingot mold section 24 and the main mold section. By preventing the solidification of the molten metal 16 in the main mold section, the metal-slag interface may be maintained in the main mold section.

By way of example, but not limitation, the refractory bottom 20 and refractory sleeve 22 could be made of Zirconia ($ZrO_2$). Zirconia is advantageous because it can remain in contact with molten steel for long periods of time with minimum reaction tendencies. Moreover, it can also survive with minimum erosion or solutioning during the molten slag start and molten metal buildup. It should be understood, however, that the refractory bottom 20 and refractory sleeve 22 are not limited to being made of Zirconia. Other refractory products which perform the same function may be substituted. Indeed, even non-refractory materials which insulate the molten metal sufficiently to keep it in a molten condition can be substituted.

The purpose in using a replaceable sleeve 22 at the head of the ingot section 24 is so that it can be replaced since this is the area of maximum wear.

Figure 2:
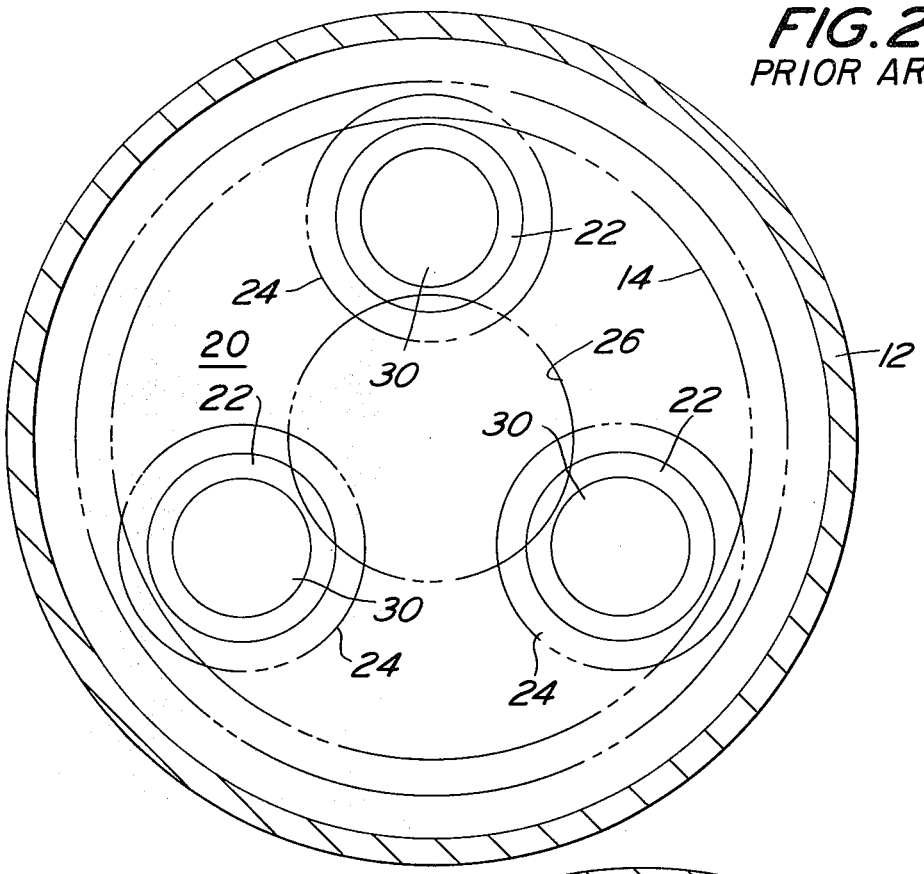
FIG. 2 PRIOR ART
FIG. 2 is a plan view of the furnace illustrated in FIG. 1.

Referring to FIG. 2, there is shown a plan view of the furnace 10 illustrated in FIG. 1. Although three cylindrical ingot mold sections 24 are illustrated in FIGS. 1 and 2, it should be understood that this is merely by way of example. The furnace may also be constructed with 2, 4 or more ingot mold sections 24. Moreover, the cross-sectional shape of an ingot mold section 24 could be other than cylindrical, if desired.

For starting the process described in U.S. Pat. No. 3,782,445 using the furnace 10 illustrated in FIGS. 2 and 3, starting plugs 30 are inserted into each of the ingot mold sections 24 so that a good electrical connection is provided for each of the ingots 28 to be formed by withdrawal of molten metal from the pool 16.

The electrode 26 is positioned above the refractory bottom 20 and within the copper jacket 14, and molten slag 18 is poured into the main mold section until its level rises to the tip of the electrode 26. Thereafter, the melting process begins. If desired, the refractory bottom 20 and refractory sleeve 22 can be preheated such as by use of a torch prior to the addition of the molten slag 18.

During the first few minutes, the electrode 26 melts at a predetermined rate, thereby covering the main mold section refractory bottom 20 with molten metal 16. After the pool of molten metal 16 is formed, ingot withdrawal is initiated and, subsequently, maintained at a rate equivalent to the melt off rate of the electrode 26. Ingot withdrawal can be accomplished by any conventional means such as by lowering the ingot 28 from a fixed ingot mold section 24 or by raising the ingot mold section 24 from a fixed ingot 28. Both processes and apparatus for accomplishing the same are known and therefore need not be described in detail. Thus, a plurality of ingots 28 can be simultaneously formed from a common pool of molten metal 16.

Control of the rate of formation of the ingots 28 depends substantially in part upon the position of the molten metal-slag interface. Since there is only one such interface, control problems are substantially reduced as compared with trying to maintain a molten metal-slag interface in each of the ingot mold sections 24. Since there is only one molten metal-slag interface, conventional controls can be used.

Although the main mold section and the ingot mold sections 24 are preferably made of water cooled copper, it should be understood that water cooled steel or other known types of molds that are compatible with the process could be used. Still further, the process is not limited to the use of consumable electrodes. It is contemplated that non-consumable electrodes or other methods of forming the molten metal 16 in the main mold section could be used with equal facility. Moreover, furnaces operated in accordance with the processes described herein may be used either for continuous casting of a plurality of ingots or for the manufacture of individual ingots.

As previously indicated, one of the major advantages of the process and apparatus described above with respect to FIGS. 1 and 2 is that a plurality of ingots 28 can be made from a common pool of molten metal 16. The process permits the use of one or more electrodes 26 melting at a relatively high rate while each ingot 28 is being cast at a relatively slower rate. Stated otherwise, in casting a plurality of ingots, the rate of casting each ingot is not strictly controlled by the rate at which the molten metal pool 16 is formed.

It has been found, however, that in casting a plurality of ingots by the above described method and apparatus, a deep molten metal core 32 forms within each ingot mold section 24. It is believed that the principal reason for the formation of the deep molten metal core 32 is an attractive force generated by the flow of electrical current through the solidifying ingots 28. It is well-known that adjacent conductors which carry current in the same direction generate attractive forces. In the above-described method and apparatus, the flow of molten metal 16 in adjacent ingot mold sections 24 may be likened to adjacent electrical conductors. Thus, in FIG. 1, there are shown two separate current paths, marked A and B, between electrode 26 and starting plugs 30 in ingot mold sections 24. Since the current paths A and B extend through separate ingot mold sections 24 and are parallel, the effect is to create attractive forces between the molten metal 16 within adjacent ingot mold sections 24. The attractive forces cause molten metal to be ejected from the top of the ingot mold sections 24 and into the molten metal pool 16 in the main mold section.

The ejection of the molten metal from the ingot mold sections 24 into the molten metal pool 16 in the main mold section above is attended by a molten metal circulation indicated by the arrows labeled C in FIG. 1. The circulation of the molten metal 16 within the ingot mold sections 24 interferes with the gradual advance of the solidification front and results in the deep molten metal cores 32.

Figure 3:
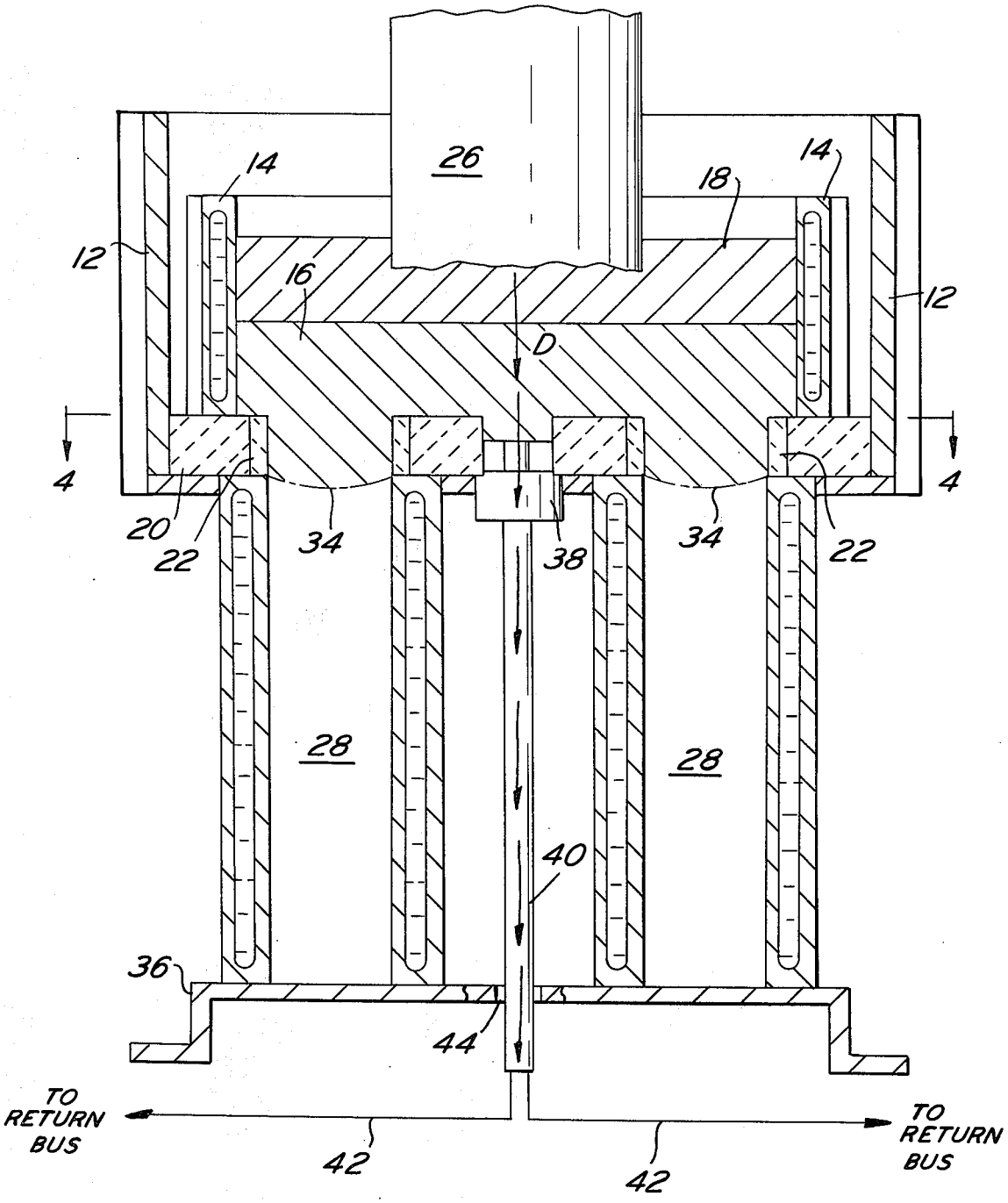
FIG. 3 is a transverse sectional view of an electroslag furnace constructed in accordance with the principles of the present invention for performing the processes described herein.

Referring to FIG. 3, the present invention provides a method and apparatus for casting a plurality of ingots from a common molten metal pool 16 while avoiding the formation of deep metal cores in the ingots 28. In particular, a starter plug 38 is disposed between adjacent ingot sections 24 to provide a good electrical connection with electrode 26. The starter plug 38 is surrounded in part by the refractory bottom 20 of the main mold section which separates adjacent ingot mold sections 24. Any suitable starter plug, known in the industry, may be inserted in the invention according to methods well-known in the art.

A water cooled copper conductor 40 is electrically connected to starter plug 38 and depends downwardly therefrom between adjacent ingot mold sections 24. In this manner, electrical current is directed from electrode 26 through molten metal pool 16 to the starter plug 38 and conductor 40 without entering an ingot mold section 24.

Using a conventional crucible drive, not shown, the main mold section and ingot mold sections 24 attached thereto may be driven upwardly as the ingots 28 are cast. Initially, ingot mold sections 24 are supported by support table 36 which is provided with an annular opening 44 through which copper conductor 40 extends. Conductor 40 terminates below opening 44 where it is electrically connected to the return buses 42 of a conventional power supply, not shown, by suitable power conductors available in the industry.

The current paths A and B, shown extending through ingot mold sections 24 FIG. 1, are eliminated by inserting starter plug 38 and copper conductor 40 as described. A single current path, then, labeled D in FIG. 3, is created; the path extends from electrode 26 through starter plug 38 and copper conductor 40 to the return buses 42 of the power supply. The solidified portions of the ingots 28, then, are effectively isolated electrically, and current will not flow through the ingots in the mold sections 24. Thereby, the molten metal circulation arising from multiple current paths is avoided. Consequently, the gradual solidification of the molten metal 16 in theingot mold sections 24 will not be impeded by the flow of current through the molten metal pool 16, and the deep molten metal cores 32, shown in FIG. 1, will not form. This is indicated in FIG. 3 by the relatively shallow solidification front 34.

The unimpeded solidification of the ingots 28 permits the ingots to be cast at a greater rate and, accordingly, results in increased furnace utilization and decreased production costs. At the same time, the metallurgical quality of the ingot is preserved.

Although described in terms of the electroslag remelting process, it should be understood that the invention herein can be applied to other electrode remelting processes, such as a vacuum arc process, or to a nonconsumable electrode process. Electroslag remelting is somewhat slower than other known processes for continuous casting of a plurality of ingots, but it results in a better product; better quality alloys result at slower solidification rates. In electroslag remelting, slower solidification rates occur because the slag blanket on top of the molten metal helps maintain heat in the pool of molten metal. Moreover, the slag blanket prevents freezing from the edge of the pool of molten metal at the slag-metal interface.

Although the conductor 40 is described as being made of copper, it should be understood that other conductive materials are also suitable for providing the single current path through the electrode 26, the starter plug 38 and the conductor 40. In addition, although current has been referred to an flowing from the electrode 26 to the conductor 40, the direction of current flow is not a limitation; the current may be alternating or direct of either polarity in practicing the present invention.

Figure 4:
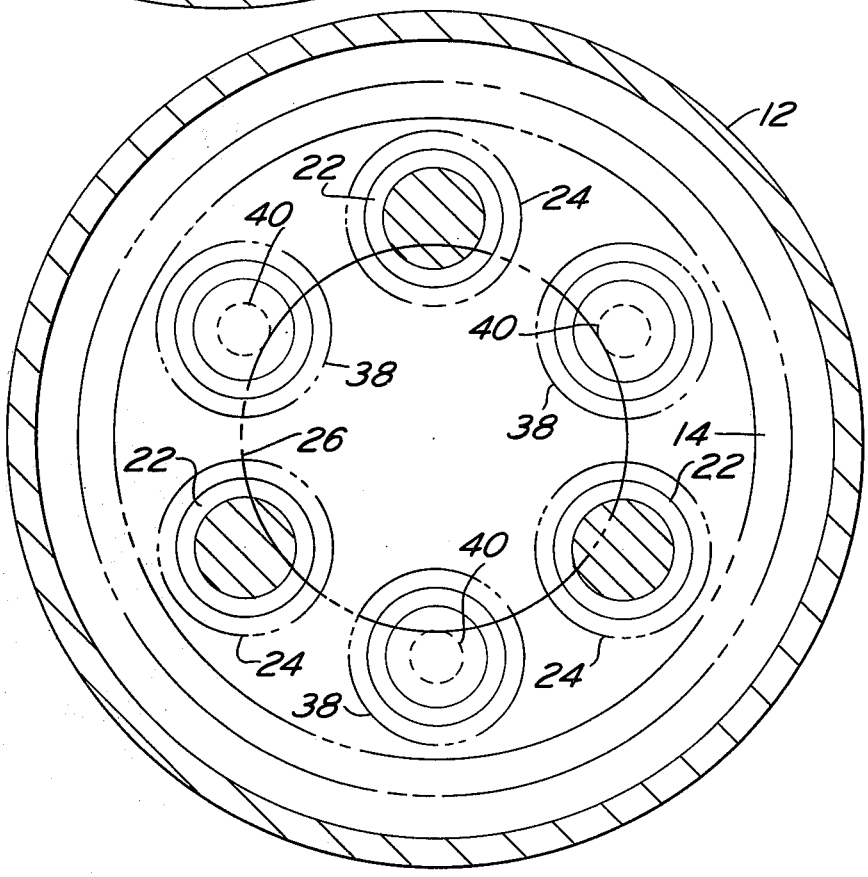
FIG. 4 is a plan view of another embodiment of a furnace constructed in accordance with the principles of the present invention for performing the processes described herein.

Further, the invention described herein is not remelting to a method and apparatus which uses only one starter plug 38 and conductor 40 to provide the single current path D. Instead, as shown in the embodiment of the invention depicted in FIG. 4, a plurality of conductors 40 may be used to generate a plurality of current paths through the molten metal pool. Each current path, however, is prevented from entering an ingot mold section 24; the currents keep the molten metal pool in the molten state, and the plurality of ingots can be cast without the formation of the deep molten metal cores 32.

The present invention may be embodied in other specific forms without departing from the spirit or essential attributes thereof and, accordingly, reference should be made to the appended claims, rather than to the foregoing specification as indicating the scope of the invention.

I claim:

1. A method of casting a plurality of ingots in a furnace comprising a main mold section in direct, open communication with a plurality of ingot mold sections having a total cross-sectional area less than the main mold section cross-sectional area, an electrode, and a conductor disposed outside the ingot mold sections, comprising the steps of forming a pool of molten metal in the main mold section, maintaining the molten metal pool in a molten state by directing an electrical current through the electrode and conductor, casting the plurality of ingots from the pool of molten metal by flowing the molten metal from the pool into the ingot mold sections while preventing the molten metal from freezing at the interface between the main mold section and the ingot mold sections, and preventing the current from entering the molten metal in the ingot mold sections.

2. A method of casting a plurality of ingots in accordance with claim 1 where the current is directed through the molten metal pool and the conductor is disposed between adjacent ingot mold sections.

3. A method of casting a plurality of ingots in accordance with claim 1 wherein the current is directed through the molten metal pool to a plurality of conductors located outside the ingot mold sections.

4. A method of casting a plurality of ingots in accordance with claim 3 wherein each conductor is disposed between adjacent ingot mold sections.

5. A method of casting a plurality of ingots in accordance with claim 2 wherein the conductor is electrically connected to a starter plug inserted between adjacent ingot mold sections.

6. A method of casting a plurality of ingots in accordance with claim 4 wherein each conductor is electrically connected to a starter plug inserted between adjacent ingot mold sections.

7. A method of casting a plurality of ingots in accordance with claim 1 wherein the preventing step includes electrically isolating the ingots.

8. A method of continuously casting a plurality of ingots in a furnace comprising a main mold section in direct, open communication with a plurality of ingot mold sections having a total cross-sectional area less than the main mold cross-sectional area, an electrode, and a conductor disposed outside the ingot mold sections, comprising the steps of forming a pool of molten metal in the main mold section, maintaining the molten metal pool in a molten state by directing an electrical current through the electrode and conductor, simultaneously casting ingots in each of the ingot mold sections by flowing the molten metal from the pool into the ingot mold sections while preventing the molten metal from freezing at the interface between the main mold section and the ingot mold sections, and preventing the current from entering the molten metal in the ingot mold sections.

9. Apparatus for casting a plurality of ingots comprising a main mold section and a plurality of ingot mold sections, the ingot mold sections being in direct, open communication with the main mold section, the main mold section having a larger cross-sectional area than the total cross-sectional area of the ingot mold sections, the main mold section including means to prevent a pool of molten metal in the main mold section from freezing at the interface between the main mold section and the ingot mold sections, and means for maintaining the molten metal pool in a molten state by directing an electrical current through the molten metal pool and for preventing the current from entering the molten metal in the ingot mold sections, said means for maintaining the molten metal pool in a molten state being disposed outside the ingot mold sections.

10. Apparatus in accordance with claim 9 wherein said means for directing current through the molten metal pool and for preventing the current from entering the molten metal in the ingot mold sections includes a conductor disposed between adjacent ingot mold sections.

11. Apparatus in accordance with claim 10 wherein said conductor is electrically connected to a starter plug inserted between adjacent ingot mold sections.

12. Apparatus in accordance with claim 9 wherein the conductor is copper.

13. A method of casting a plurality of ingots in a consumable electrode furnace comprising a main mold section in direct, open communication with a plurality of ingot mold sections having a total cross-sectional area less than the cross-sectional area of the main mold section, an electrode, and a conductor disposed outside the ingot mold sections, comprising the steps of fusing the electrode to form a pool of molten metal in the main mold section, cooling the main mold section and the ingot mold sections, maintaining the pool of molten metal in the main mold section, by directing an electrical current through the electrode and conductor while preventing current from entering the molten metal in the ingot mold sections, and casting a plurality of ingots in the ingot mold sections while preventing the molten metal in the pool from freezing at the interface between the main mold section and the ingot mold sections.

14. A method of casting a plurality of ingots in accordance with claim 13 including the step of fusing the electrode under molten slag within the main mold section to form the pool of molten metal.

15. A method of casting a plurality of ingots in accordance with claim 13 wherein the step of directing the current through the molten metal while preventing the current from entering the molten metal in the ingot mold sections includes inserting a conductor between adjacent ingot mold sections.

16. A method of casting a plurality of ingots in accordance with claim 15 wherein the step of directing the current through the molten metal while preventing the current from entering the molten metal in the ingot mold sections includes inserting a starter plug between adjacent ingot mold sections and electrically connecting the conductor to the starter plug.

17. A method of casting a plurality of ingots in accordance with claim 15 wherein the conductor is copper.

18. A method of casting a plurality of ingots in a consumable electrode furnace comprising a main mold section and a plurality of ingot mold sections in direct, open communication with the main mold section, the main mold section having a larger cross-sectional area than the total cross-sectional area of the ingot mold sections, an electrode, and a conductor disposed outside the ingot mold sections, comprising the steps of fusing the electrode under molten slag to form a pool of molten metal in the main mold section cooling the main mold section and the ingot mold sections, maintaining the pool of molten metal in the main mold section, simultaneously fusing the electrode by directing an electrical current through the electrode and conductor while preventing the current from entering the molten metal in the ingot mold sections and casting a plurality of ingots in the ingot mold sections while preventing the molten metal in the pool from freezing at the interface between the main mold section and the ingot mold sections.

19. A method of casting a plurality of ingots in accordance with claim 18 wherein the step of directing the current through the molten metal while preventing the current from entering the molten metal in the ingot mold sections includes inserting a conductor between adjacent ingot mold sections.

20. A method for casting a plurality of ingots in accordance with claim 19 wherein the step of directing the current through the molten metal while preventing the current from entering the molten metal in the ingot mold sections includes inserting a starter plug between adjacent ingot mold sections and electrically connecting the conductor to the starter plug.

21. A method of casting a plurality of ingots in accordance with claim 19 wherein the conductor is copper.

22. A method for simultaneously casting plurality of metal ingots in a consumable electrode electroslag furnace in which an electrode is fused under molten slag to form molten metal to be cast into ingots, said furnace comprising a main mold section for containing molten metal and molten slag and a plurality of ingot mold sections in direct, open communication with the main mold section, the main mold section having a larger cross-sectional area than the total cross-sectional area of the ingot mold sections in communication therewith, an electrode, and a conductor disposed outside the ingot mold sections, comprising the steps of fusing a consumable electrode under molten slag to form a pool of molten metal in said main mold section with said molten slag overlying said molten metal by directing an electrical current through the electrode and conductor, maintaining said pool of molten metal in said main mold section in intimate contact with each of the ingot mold sections throughout the full cross-section of each ingot mold section, solidifying the molten metal in said plurality of ingot mold sections and cooling each of said ingot mold sections while preventing the current from entering the molten metal in the ingot mold sections and preventing the pool of molten metal in the main mold section from solidifying at the interface between the main mold section and the ingot mold sections by heat insulating the tops of said ingot mold sections and the bottom of the main mold section from the cooling effect of the ingot mold sections.

* * * * *